US011492779B2

(12) United States Patent
Harshman et al.

(10) Patent No.: US 11,492,779 B2
(45) Date of Patent: Nov. 8, 2022

(54) CIRCLE DRIVE SYSTEM FOR A GRADING MACHINE

(71) Applicant: Caterpillar Inc., Deerfield, IL (US)

(72) Inventors: Nathaniel K. Harshman, Sullivan, IL (US); Akilan Appavu, Tamilnadu (IN); Anand Kesheorey, Karnataka (IN)

(73) Assignee: Caterpillar Inc., Peoria, IL (US)

( * ) Notice: Subject to any disclaimer, the term of this patent is extended or adjusted under 35 U.S.C. 154(b) by 637 days.

(21) Appl. No.: 16/419,218

(22) Filed: May 22, 2019

(65) Prior Publication Data

US 2020/0370276 A1 Nov. 26, 2020

(51) Int. Cl.
*E02F 3/84* (2006.01)
*E02F 3/76* (2006.01)

(52) U.S. Cl.
CPC ..... *E02F 3/84* (2013.01); *E02F 3/764* (2013.01)

(58) Field of Classification Search
CPC . E02F 3/84; E02F 3/764; E02F 3/8157; E02F 3/7636; E02F 3/7645; E02F 3/765; E02F 3/7654; E02F 3/7659; E02F 3/844
See application file for complete search history.

(56) References Cited

U.S. PATENT DOCUMENTS 1,769,683 A * 7/1930 Faverty ..... E02F 3/7636 280/80.1
1,769,716 A * 7/1930 Schlacks ..... E02F 3/764 172/796
1,841,403 A * 1/1932 Dean ..... E02F 3/844 172/796
2,323,108 A * 6/1943 Arndt ..... E02F 3/764 172/796
2,670,551 A * 3/1954 Keeler ..... E02F 3/7636 172/796
2,811,139 A * 10/1957 Lado ..... F16H 43/00 91/176
3,512,589 A * 5/1970 Ulrich ..... E02F 3/815 172/786
3,712,384 A * 1/1973 Fisher ..... E02F 3/764 172/796
3,880,302 A * 4/1975 Legille ..... C21B 7/20 414/206
4,016,936 A * 4/1977 Easterling ..... E02F 3/764 172/796
4,084,644 A * 4/1978 Cole ..... E02F 3/764 172/719
4,122,903 A * 10/1978 Cole ..... E02F 3/764 172/747
5,636,071 A * 6/1997 Mochizuki ..... B60R 1/074 248/476
6,694,833 B2 2/2004 Hoehn et al.
9,540,787 B2 * 1/2017 West ..... E02F 3/847
(Continued)

*Primary Examiner* — Jamie L McGowan

(57) ABSTRACT

A grading machine includes a machine body, a grading blade supported by a circle, a drawbar connecting the grading blade and the circle to the machine body, and a circle drive system including a circle drive motor and a gear box. The gear box is configured to engage with and rotate the circle relative to the drawbar around a circle axis. The gear box includes a first gear that rotates about a first axis of rotation that is parallel to the circle axis, and the gear box also includes a second gear that rotates about a second axis that is parallel to the circle axis and spaced away from the first axis of rotation.

18 Claims, 4 Drawing Sheets

(56) References Cited

U.S. PATENT DOCUMENTS

| | | | | |
|---|---|---|---|---|
| 9,644,341 | B2 * | 5/2017 | Yoshimura | E02F 3/7654 |
| 2012/0073890 | A1 * | 3/2012 | Bindl | E02F 3/764<br>180/69.6 |
| 2012/0279339 | A1 * | 11/2012 | Notaras | A01G 3/00<br>74/421 R |
| 2014/0251648 | A1 * | 9/2014 | Staade | E02F 3/7654<br>172/796 |
| 2016/0108604 | A1 * | 4/2016 | West | E02F 3/847<br>701/50 |
| 2018/0162221 | A1 * | 6/2018 | Long | B60K 17/04 |

* cited by examiner

CIRCLE DRIVE SYSTEM FOR A GRADING MACHINE

TECHNICAL FIELD

The present disclosure relates generally to a grading machine, and more particularly, to a system for driving a circle on a grading machine.

BACKGROUND

The present disclosure relates to mobile machines that are used in grading. Grading machines, such as motor graders, are typically used to cut, spread, or level material that forms a ground surface. To perform such earth sculpting tasks, grading machines include a blade, also referred to as a moldboard or implement. The blade moves relatively small quantities of earth from side to side, in comparison to a bulldozer or other machine that moves larger quantities of earth. Grading machines are frequently used to form a variety of final earth arrangements, which often require the blade to be positioned in different positions and/or orientations depending on the sculpting task and/or the material being sculpted. The different blade positions may include the blade pitch or the blade cutting angle. A circle drive may control a position of a circle coupled to the blade, and thus adjust the blade cutting angle. Different blade positions may require different amounts of torque in order to adjust the blade, especially when the blade is engaged with material.

U.S. Pat. No. 9,540,787, issued to West et al. on Jan. 10, 2017 ("the '787 patent"), describes an apparatus for positioning a circle and a moldboard relative to a frame of a grading machine. The '787 patent includes a circle drive to control the circle and the moldboard, and the circle drive is coupled to a gear apparatus with an output shaft configured to mesh with and rotate the circle relative to the machine frame. The gear apparatus in the '787 patent may increase the torque on the output shaft that rotates the circle relative the frame. However, the apparatus for controlling the circle and moldboard of the '787 patent may interfere with other components of the grading machine, may be limited in the amount torque that may be delivered, and/or may reduce the range of motion or orientation options for the grading machine. The system for a grading machine of the present disclosure may solve one or more of the problems set forth above and/or other problems in the art. The scope of the current disclosure, however, is defined by the attached claims, and not by the ability to solve any specific problem.

SUMMARY

In one aspect, a grading machine may include a machine body, a grading blade supported by a circle, a drawbar connecting the grading blade and the circle to the machine body, and a circle drive system including a circle drive motor and a gear box. The gear box may be configured to engage with and rotate the circle relative to the drawbar around a circle axis. The gear box may include a first gear that rotates about a first axis of rotation that is parallel to the circle axis, and the gear box also may include a second gear that rotates about a second axis that is parallel to the circle axis and spaced away from the first axis of rotation.

In another aspect, a grading machine may include a grading blade supported by a circle, a drawbar connected to the circle, and at least one circle drive system including a circle drive motor and a gear box. The gear box may include a first gear coupled to a first shaft, and the first gear and the first shaft may rotate around a first gear box axis of rotation. The gear box may include a second gear coupled to a second shaft, and the second gear and the second shaft may rotate around a second gear box axis of rotation. The first gear box axis of rotation and the second gear box axis of rotation may be parallel and spaced apart.

In a further aspect, a blade positioning system for a grading machine may include a circle coupled to a grading blade and a circle drive system. The circle may be rotatable around a circle axis. The circle drive system may include a circle drive motor with a motor axis, a gear coupling coupled to the circle drive motor, and a gear box driven by the circle drive motor and the gear coupling. The gear box may be configured to engage with and drive a rotation of the circle. The gear box may include at least a first axis of rotation and a second axis of rotation. The first axis of rotation and the second axis of rotation may be parallel to each other and to the circle axis. The first axis of rotation and the second axis of rotation may be offset from each other.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of surfaces or materials that may be worked in material moving procedures (e.g., gravel, clay, sand, dirt, etc.) and/or can be cut, spread, sculpted, smoothed, leveled, graded, or otherwise treated. In this disclosure, unless stated otherwise, relative terms, such as, for example, "about," "substantially," and "approximately" are used to indicate a possible variation of ±10% in the stated value.

Figure 1:
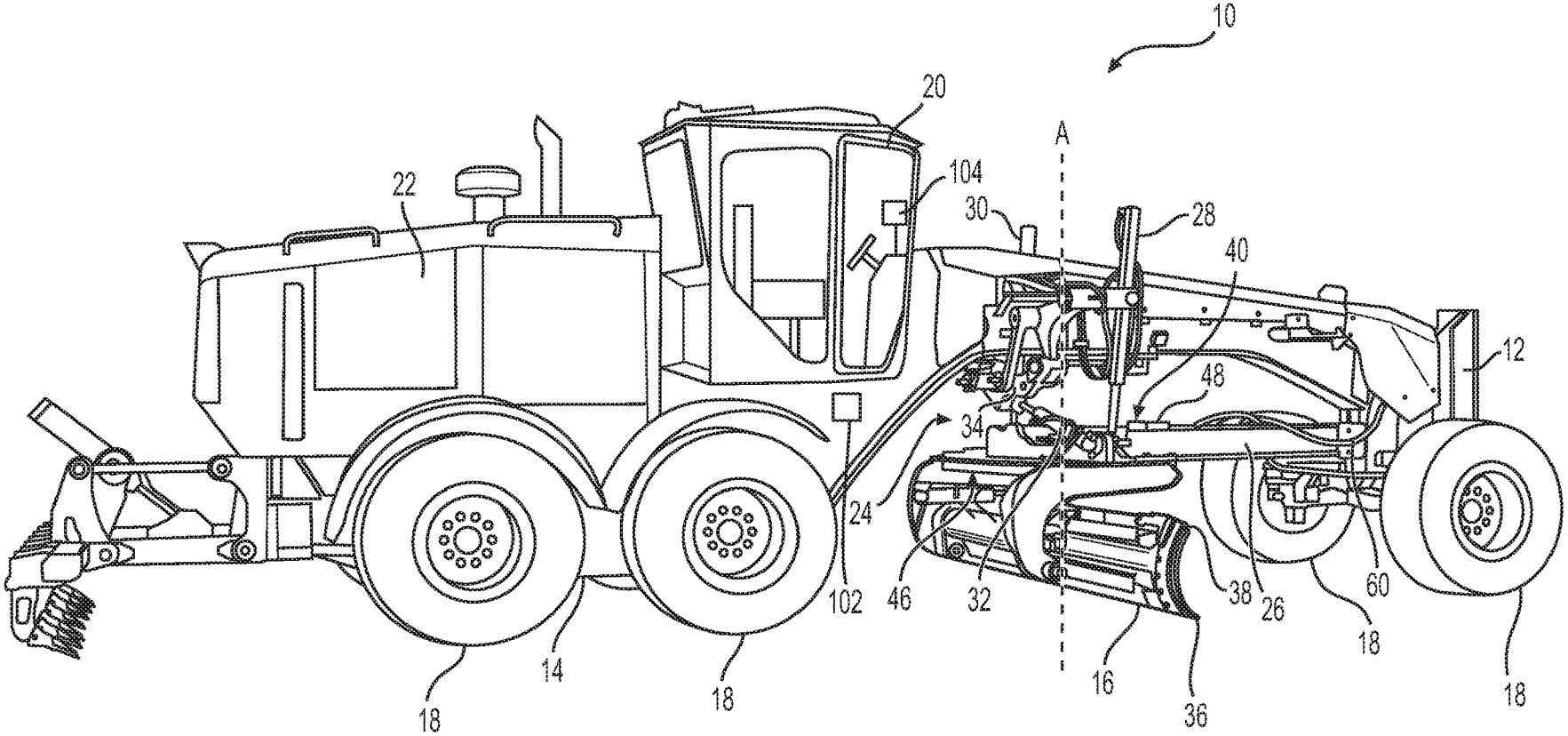
FIG. 1 is an illustration of an exemplary grading machine according to aspects of this disclosure.

FIG. 1 illustrates a perspective view of an exemplary motor grader machine 10 (hereinafter "motor grader"), according to the present disclosure. Motor grader 10 includes a front frame 12, a rear frame 14, and a blade 16.

Front frame 12 and rear frame 14 are supported by wheels 18. An operator cab 20 may be mounted above a coupling of front frame 12 and rear frame 14, and may include various controls, display units, touch screens, or user interfaces, for example, user interface 104, to operate or monitor the status of the motor grader 10. Rear frame 14 also includes an engine 22 to drive and/or power motor grader 10. Blade 16, sometimes referred to as a moldboard, is used to cut, spread, or level (collectively "sculpt") earth or other material traversed by motor grader 10. As shown in greater detail in FIG. 2, blade 16 is mounted on a linkage assembly, shown generally at 24. Linkage assembly 24 allows blade 16 to be moved to a variety of different positions and orientations relative to motor grader 10, and thus sculpt the traversed ground surface in different ways. Additionally, a circle drive system 40 may include or be coupled to a motor, and circle drive system 40 may include a gearing arrangement in order to engage with and rotate a circle 46 (FIGS. 1 and 2) in order to adjust at least one aspect of blade 16.

Additionally, a controller 102 may be in communication with one or more features of motor grader 10 and receive inputs from and send outputs to, for example, user interface 104 in cab 20 or an interface remote from motor grader 10. In one aspect, motor grader 10 may be an electrohydraulic motor grader, and controller 102 may control one or more electrical switches or valves in order to control one or more hydraulic cylinders or electrical elements in order to operate motor grader 10.

Starting at the front of the motor grader 10 and working rearward toward the blade 16, linkage assembly 24 includes a drawbar 26. Drawbar 26 is pivotably mounted to the front frame 12 with a ball joint (not shown). The position of drawbar 26 may be controlled by hydraulic cylinders, including, for example, a right lift cylinder 28, a left lift cylinder 30, a centershift cylinder 32, and a linkbar 34. A height of blade 16 with respect to the surface being traversed below motor grader 10, commonly referred to as blade height, may be primarily controlled and/or adjusted with right lift cylinder 28 and left lift cylinder 30. Right lift cylinder 28 and left lift cylinder 30 may be controlled independently and, thus, may be used to tilt a bottom of blade 16, which includes a bottom cutting edge 36 and a top edge 38. Based on the positions of right lift cylinder 28 and left lift cylinder 30, cutting edge 36 may be tilted relative to the traversed material, so lift cylinders 28 and 30 may control a blade tilt. Right lift cylinder 28 and left lift cylinder 30 may also be used (e.g., extended or retracted simultaneously) to control the height of blade 16 relative to motor grader 10 in order to control depth of the cut into the ground surface or a height of blade 16 above the ground surface. For example, for an aggressive cut or sculpting procedure, right lift cylinder 28 and left lift cylinder 30 may be extended such that blade 16 is extended away from motor grader 10 to a lower depth. On the other hand, if motor grader 10 is performing a light sculpting procedure, is traversing a ground surface between sculpting procedures, or where it is otherwise desirable for blade 16 to not contact the ground surface, right lift cylinder 28 and left lift cylinder 30 may be retracted such that drawbar 26 and blade 16 are lifted up toward motor grader 10.

Centershift cylinder 32 and linkbar 34 may be used primarily to shift a lateral position of drawbar 26, and any components mounted to drawbar 26, relative to front frame 12. This lateral shifting is commonly referred to as drawbar centershift. Centershift cylinder 32 may include one end coupled to drawbar 26, and another end pivotably coupled to linkbar 34. Linkbar 34 may include a plurality of position holes 70 for selectively positioning linkbar 34 to the left or right to allow for further shifting of drawbar 26 to a left or right side of the motor grader 10 by centershift cylinder 32.

Figure 2:
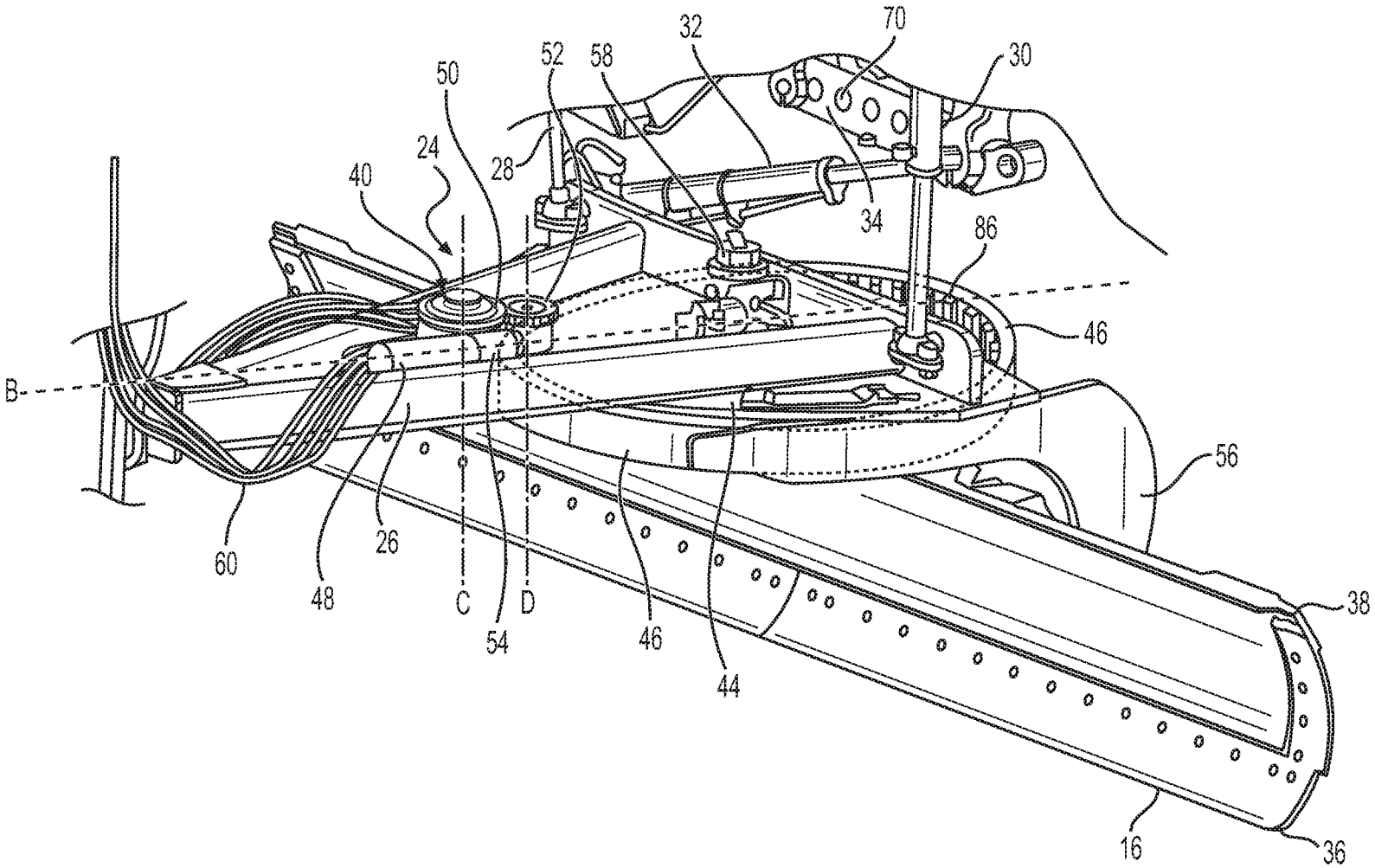
FIG. 2 is a perspective view of the grading portion of the grading machine of FIG. 1.

As shown in FIG. 2, drawbar 26 is coupled to a large, flat plate, commonly referred to as a yoke plate 44. Beneath yoke plate 44 is a large gear, commonly referred to as a circle 46. Circle 46 includes a plurality of teeth 86 that extend along an inner face of circle 46. It is noted that FIG. 2 shows teeth 86 only on a portion of circle 46, but teeth 86 may extend along the entirety of the inner face of circle 46. Furthermore, yoke plate 44 may extend over an entirety of circle 46, but is shown as having a reduced size in FIG. 2 in order to expose a portion of circle 46 and teeth 86.

Circle 46 and blade 16 may be coupled via support arms 56 and a support plate (not shown). Circle 46 may be rotated by circle drive system 40. Circle drive system 40 may include a circle drive motor 48 and a gear box 50. As shown in FIG. 2, circle drive motor 48 may be a hydraulic motor coupled to one or more hydraulic lines 60, and may be in communication with controller 102 and/or user interface 104. Alternatively, circle drive motor 48 may be an electric motor or any other appropriate type of motor. Circle drive motor 48 may be any motor that includes or is coupled to a rotational output shaft, for example, a gear motor, a vane motor, an axial plunger motor, a radial piston motor, etc. Gear box 50 may include or be coupled to one or more spur gear assemblies 52 (FIGS. 3 and 4), and a gear coupling 54 may couple circle drive motor 48 to gear box 50 and the internal spur gear assembly 52. The rotation of circle 46 by circle drive system 40 adjusts a circle angle and pivots blade 16 about an axis A (FIG. 1) fixed to drawbar 26 to establish a blade cutting angle. The blade cutting angle is defined as the angle of blade 16 relative to front frame 12, and the blade cutting angle may be controlled by a combination of the position of circle 46 and the position of drawbar 26.

Based on the effect of circle drive system 40, circle 46 and blade 16 may be rotated clockwise or counterclockwise relative to front frame 12 about axis A. In one aspect, circle 46 and blade 16 may be rotated up to approximately 75 degrees clockwise or counterclockwise about axis A. In another aspect, circle 46 and blade 16 may be rotated 360 degrees clockwise or counterclockwise about axis A. In either aspect, at a 0 degree blade cutting angle, blade 16 is arranged at a right angle to the front frame 12. Furthermore, a circle angle sensor 58 (FIG. 2), for example, a rotary sensor, inertial measurement unit, etc., may be positioned on circle 46 to measure an angular rotation of circle 46, and thus an angle of blade 16. In one aspect, circle angle sensor 58 may be mounted in a centered position on circle 46. In another aspect, circle angle sensor 58 may be mounted in an off-centered position on circle 46, and circle angle sensor 58 or other internal components of motor grader 10 may be used to calculate the position of circle 46 and blade 16 based on a compensation or correction to account for the off-centered position of circle angle sensor 58. Circle angle sensor 58 may also help to prevent blade 16 from being positioned at such an angle where blade 16 may contact or otherwise interfere with wheels 18. For example, circle angle sensor 58 may be in communication with controller 102, and may indicate a warning if a selected position would position blade 16 at an angle where blade 16 may contact wheels 18 or other portions of motor grader 10.

As shown in FIGS. 1 and 2, motor grader 10 may include a plurality of hydraulic lines 60 in order to control the hydraulic cylinders and/or hydraulic motors. Motor grader 10 may include a hydraulic pump (not shown). The hydraulic pump may supply high pressure hydraulic fluid through one or more of hydraulic lines 60 to one or more of the hydraulic cylinders. A low pilot pressure may be provided by a hydraulic pressure reducing valve, which can receive the high pressure hydraulic fluid and supply low pilot pressure to each hydraulic cylinder. Additionally, each hydraulic cylinder may include an electrical solenoid and one or more hydraulic valves. The solenoid may receive one or more signals from controller 102 to control and position each hydraulic cylinder by configuring the flow of hydraulic fluid through the valves. The delivery of the hydraulic fluid may be controlled by controller 102, for example, via one or more user interfaces 104. In one aspect, controller 102 controls the delivery of hydraulic fluid through hydraulic lines 60 to circle drive motor 48 to control the position of circle 46 and blade 16.

Figure 3:
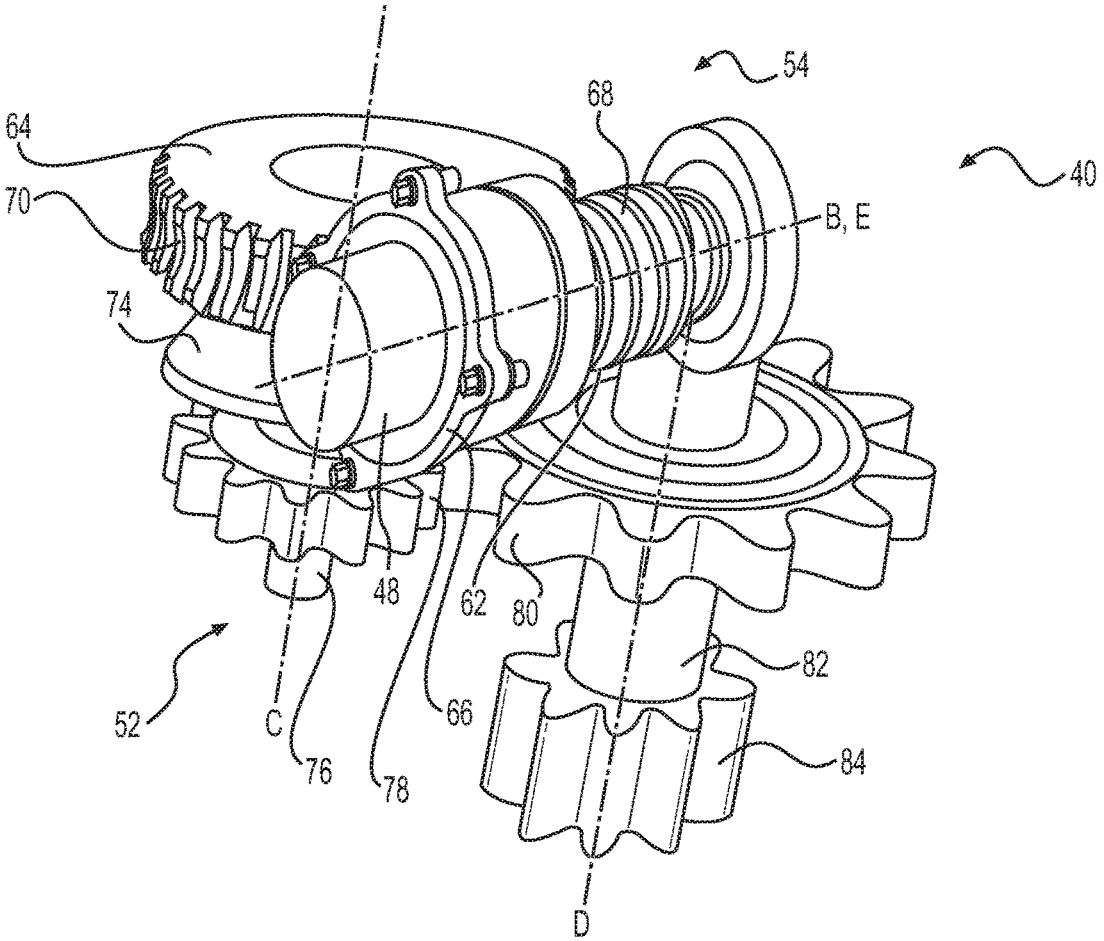
FIG. 3 is a partially exploded view of a portion of a circle drive system for the exemplary grading machine of FIG. 1.
Figure 4:
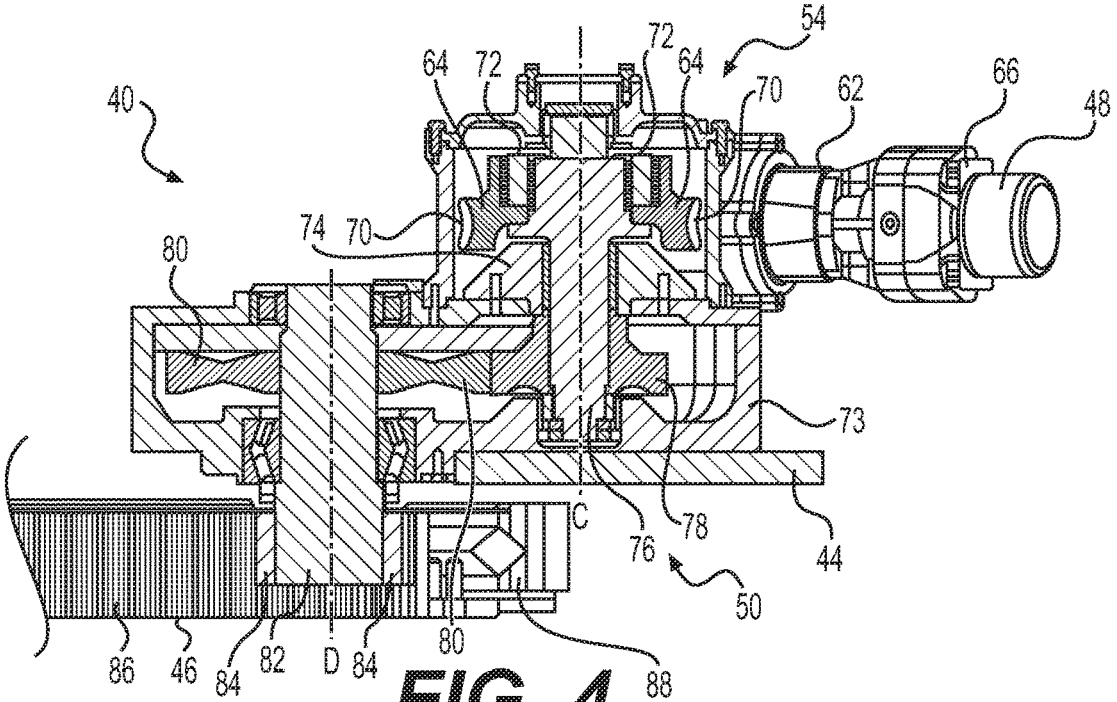
FIG. 4 is a cross-sectional view of the exemplary circle drive system of FIG. 3.

FIGS. 3 and 4 illustrate further details of portions of circle drive system 40. As mentioned above, circle drive system 40 may include one or more gear couplings 54 connecting circle drive motor 48 (shown smaller in FIGS. 3 and 4 than in FIG. 2 for clarity) and gear box 50. As shown in FIGS. 2 and 3, circle drive motor 48 may have an axis of rotation B, and gear box 50 may have a first axis of rotation C and a second axis of rotation D. As shown in FIGS. 3 and 4, a first shaft 76 and a first spur gear 78 may rotate around axis C, and a second shaft 82 and a second gear 80 may rotate around axis D. Axes of rotation C and D for gear box 50 are spaced apart or offset from one another and are substantially parallel to each other. Axes of rotation C and D may also be parallel to axis A of circle 46. The one or more gear couplings 54 may allow for the axis of rotation B for circle drive motor 48 to be substantially perpendicular to axes of rotation C and D for gear box 50. Stated another way, the one or more gear couplings 54 may enable a transmission of power from along a first axis to along a second axis that is perpendicular to the first axis. Accordingly, rotation of circle drive motor 48 around motor axis B rotates elements of gear box 50 around axis C and axis D, and thus rotates circle 46 and blade 16 around axis A. Gear coupling 54 may include a worm gear 64 (as shown), a bevel gear, or any other appropriate gear assembly to couple gear assemblies with perpendicular axes of rotation.

In the aspect where gear coupling 54 includes a worm gear, gear coupling 54 includes a worm 62 and a worm gear 64. Worm 62 may be coupled to an output shaft of circle drive motor 48, for example, via a motor mount 66, or may be coupled to circle drive motor 48, for example, via a shaft (not shown). Accordingly, circle drive motor 48 may rotate worm 62 around a worm axis E, and worm axis E may be substantially parallel or coaxial to motor axis B (as shown). Worm 62 may include helical teeth 68 that engage with gears 70 of worm gear 64, such that rotation of worm 62 then rotates worm gear 64. Worm gear 64 rotates around axis C of gear box 50. Worm gear 64 may then be coupled directly or indirectly to one or more portions of gear box 50, for example, the one or more spur gear assemblies 52. Gear coupling 54 may also include one or more slip clutches 72 and/or brakes, which may help to protect circle drive motor 48 and gear coupling 54 in a situation where blade 16 or circle 46 encounters a heavy or severe external load while traversing the ground surface. Alternatively or additionally, although not shown, gear coupling 54 may include a bevel gear or any other appropriate gear assembly to engage with and drive one or more components of the spur gear assemblies 52.

Gear box 50 may include a combining interface 74. Combining interface 74 may help support and/or separate various portions of gear box 50 and/or may help connect gear coupling 54 to the other portions of gear box 50. For example, although not shown, combining interface 74 may include an exterior with threaded holes or other coupling mechanisms to couple exterior components of gear coupling 54 to other portions of gear box 50. As shown in FIG. 4, a housing 73 may enclose the one or more spur gear assemblies 52, and may be mounted on yoke plate 44. Mounting housing 73 on yoke plate 44 may couple circle drive system 40 to linkage assembly 24 (FIGS. 1 and 2).

Worm gear 64 may be directly coupled to one or more interior portions of gear box 50. For example, a shaft 76 may extend from worm gear 64 and be coupled to a first spur gear 78. Alternatively, although not shown, worm gear 64 may be directly or indirectly coupled to first spur gear 78. Accordingly, in either aspect, rotation of worm gear 64 rotates first spur gear 78 of the one or more spur gear assemblies 52. Shaft 76 and first spur gear 78 may rotate around axis C. First spur gear 78 engages with a second spur gear 80. Second spur gear 80 is coupled to a second shaft, for example, a drive shaft 82. Second spur gear 80 and drive shaft 82 may rotate around axis D. Drive shaft 82 includes a circle engaging gear 84. Rotation of second spur gear 80, via engagement with first spur gear 78, drives the rotation of drive shaft 82 and circle engaging gear 84. Circle engaging gear 84 may engage with teeth 86 on the internal face of circle 46 such that rotation of circle engaging gear 84 rotates circle 46, and thus controls a blade angle of blade 16. It is noted that the cross-sectional view of circle 46 shown in FIG. 4 includes one or more internal components of circle, which may include, for example, support elements, position sensors, etc.

Figure 5:
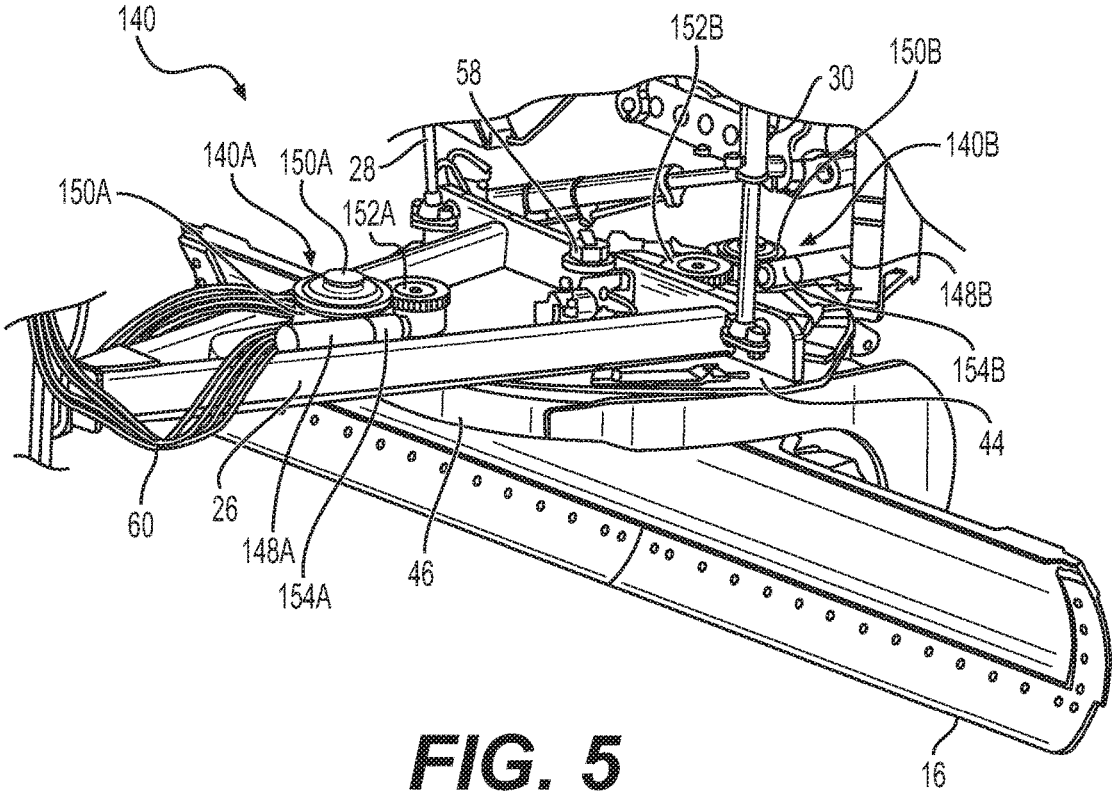
FIG. 5 is a perspective view of another exemplary grading portion of a grading machine according to aspects of the disclosure.

FIG. 5 illustrates another configuration of an exemplary circle drive system 140, with similar elements to circle drive system 40 shown by 100 added to the reference numbers. Circle drive system 140 may be incorporated on motor grader 10 of FIG. 1 to position circle 46 and blade 16. As shown, circle drive system 140 includes a front circle drive system 140A and a rear circle drive system 140B. Front circle drive system 140A and rear circle drive system 140B may be positioned at a front and a rear of yoke plate 44 and drive front and rear portions of circle 46. Front circle drive system 140A and rear circle drive system 140B may be longitudinally spaced apart and may both be aligned with a drawbar centerline. Front circle drive system 140A includes a front circle drive motor 148A and a front gear box 150A, with front circle drive motor 148A and front gear box 150A coupled via a front gear coupling 154A. Rear circle drive system 140B includes a rear circle drive motor 148B and a rear gear box 150B, with rear circle drive motor 148B and rear gear box 150B coupled via a rear gear coupling 154B. Both circle drive motors 148A, 148B may drive portions of gear couplings 154A, 154B, which may then drive respective drive gear boxes 150A, 150B in order to rotate and position circle 46 and blade 16. As in FIGS. 1-4, each of gear boxes 150A, 150B may include a spur gear assembly 152A, 152B with two spur gears with respective parallel rotation axes that are perpendicular to an axis of circle drive motors 148A, 148B.

Figure 6:
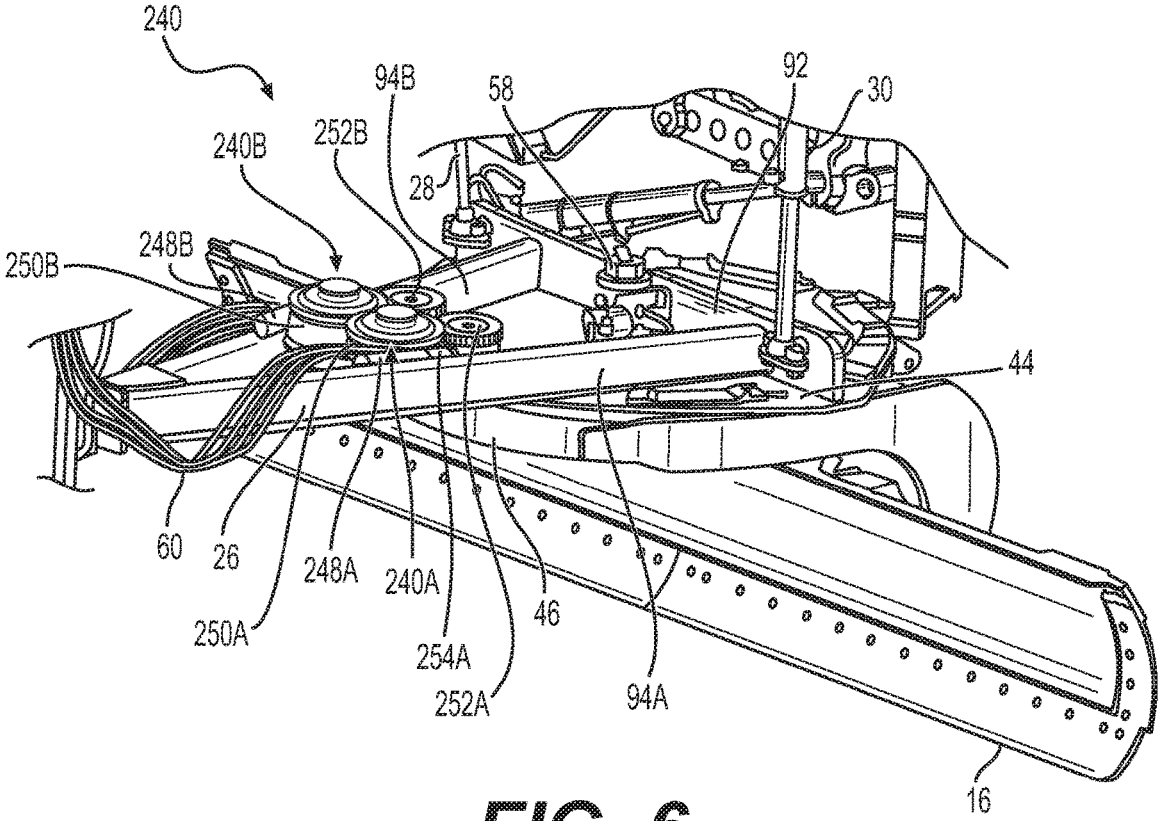
FIG. 6 is a perspective view of a further exemplary grading portion of a grading machine according to aspects of the disclosure.

FIG. 6 illustrates another configuration of an exemplary circle drive system 240, with similar elements to circle drive system 40 shown by 200 added to the reference numbers. Circle drive system 240 may be incorporated on motor grader 10 of FIG. 1 to position circle 46 and blade 16. As shown, circle drive system 240 includes two front circle drive systems 240A and 240B positioned on a left and a right side of the drawbar centerline. Left circle drive system 240A includes a left circle drive motor 248A and a left gear box 250A, with left circle drive motor 248A and left gear box 250A coupled via a left gear coupling 254A. Right circle drive system 240B includes a right circle drive motor 248B and a right gear box 250B, with right circle drive motor 248B and right gear box 250B coupled via a right gear coupling 254B. Both circle drive motors 248A, 248B may drive portions of gear couplings 254A, 254B, which may then drive respective drive gear boxes 250A, 250B in order to rotate and position circle 46 and blade 16. As in FIGS. 1-5, each of gear boxes 250A, 250B may include a spur gear assembly 252A, 252B two spur gears with respective parallel rotation axes that are perpendicular to an axis of circle drive motors 248A, 248B.

As shown in FIG. 6, circle drive systems 240A and 240B may be coupled to a front portion of circle 46. In addition, a crossbeam 92 connecting drawbar arms 94A and 94B may be larger, stiffer, or otherwise help to support and brace drawbar 26 and the components supported by drawbar 26 (e.g., circle 46, blade 16, etc.) to receive forces as motor grader 10 traverses the ground surface. Moreover, although not shown, motor grader 10 may include additional crossbeams connecting drawbar arms 94A and 94B, for example, above a rear portion of circle 46.

It is noted that motor grader 10 may include any number of circle drive systems 40, 140A, 140B, 240A, 240B. Motor grader 10 may include one circle drive system 40 (FIGS. 1-4), may include two circle drive systems 140A, 140B, 240A, 240B (FIGS. 5 and 6), or may include more than two circle drive systems. The one or more circle drive systems 40, 140A, 140B, 240A, 240B may be coupled to various portions of circle 46, and each circle drive system 40, 140A, 140B, 240A, 240B and components of each circle drive system 40, 140A, 140B, 240A, 240B may be different sizes. Referring to FIG. 5, front circle drive system 140A may be larger than rear circle drive system 140B. For example, front circle drive motor 148A may be larger than rear circle drive motor 148B, and/or front gear box 150A may be larger than rear gear box 150B. Additionally, spur gear assemblies 52, 152A, 152B, 252A, and 252B may include any number of spur gears that are configured to engage with each other in order to deliver torque to circle 46. Although not shown, spur gear assemblies 52, 152A, 152B, 252A, and 252B may include three, four, five, etc. spur gears and shafts. Moreover, spur gears 78 and 80 may be different sizes depending on the gear reduction and/or torque requirements for machine 10, as different machines and different grading operations may require different amounts of torque to position blade 16.

INDUSTRIAL APPLICABILITY

The disclosed aspects of motor grader 10 may be used in any grading or sculpting machine to assist in positioning a blade 16 and/or circle 46. Circle drive systems 40, 140A, 140B, 240A, 240B may help an operator position and orient blade 16 and circle 46. Additionally, the spur gear assemblies 52, 152A, 152B, 252A, and 252B in gear boxes 50, 150A, 150B, 250A, 250B may help to deliver a greater amount of torque to teeth 86 on the internal face of circle 46 or other components of blade 16 and circle 46. Such an increase in torque may be beneficial when adjusting a position of blade 16 and circle 46 when blade 16 is engaged with material on a ground surface or is otherwise under the effect of external forces. Including offset spur gears 78 and 80 may allow for spur gears 78 and 80 to be larger gears, and thus may allow for spur gears 78 and 80 to provide an increased gear reduction and/or deliver a greater amount of torque to circle 46. Offset spur gears 78 and 80, along with offset shafts 76 and 82, may allow for the height of spur gear assembly 52 to be reduced.

Moreover, gear couplings 54, 154A, 154B, 254A, 254B allow for circle drive motors 48, 148A, 148B, 248A, 248B to be positioned unaligned with gear boxes 50, 150A, 150B, 250A, 250B and circle 46. For example, as shown in FIGS. 2, 5 and 6, circle drive motors 48, 148A, 148B, 248A, 248B include an axis B, and gear boxes 50, 150A, 150B, 250A, 250B include axes C and D perpendicular to axis B. As a result, the overall height of circle drive systems 40, 140A, 140B, 240A, 240B may be reduced. Furthermore, as drawbar 26, circle 46, and blade 16 are lifted toward front frame 12 by right lift cylinder 28 and left lift cylinder 30 to a retracted position, drawbar 26, circle 46, and blade 16 may be lifted to a higher position than if circle drive motors 48, 148A, 148B, 248A, 248B were aligned with (and above) gear boxes 50, 150A, 150B, 250A, 250B and circle 46. Similarly, drawbar 26, circle 46, and blade 16 may be positioned to a large number of positions and/or have a wide freedom of movement when controlled by right lift cylinder 28, left lift cylinder 30, centershift cylinder 32, linkbar 34, etc., as a result of the arrangement of the circle drive motors 48, 148A, 148B, 248A, 248B and gear boxes 50, 150A, 150B, 250A, 250B. There may also be a reduced likelihood that a portion of circle drive systems 40, 140A, 140B, 240A, 240B would contact or be damaged by front frame 12 during positioning of drawbar 26, circle 46, and blade 16 during a sculpting procedure. Gear boxes 50, 150A, 150B, 250A, 250B may be able to accommodate larger or additional spur gear assemblies 52, 152A, 152B, 252A, and 252B because circle drive motors 48, 148A, 148B, 248A, 248B are offset from gear boxes 50, 150A, 150B, 250A, 250B. Moreover, circle drive motors 48, 148A, 148B, 248A, 248B may be larger or more powerful motors because circle drive motors 48, 148A, 148B, 248A, 248B are offset from gear boxes 50, 150A, 150B, 250A, 250B.

As shown in FIGS. 5 and 6, motor grader 10 may include more than one circle drive system 140A, 140B, 240A, 240B. Including more than one circle drive system 140A, 140B, 240A, 240B may reduce the overall size of each circle drive system, in addition to reducing the overall height as discussed above. For example, motor grader 10 may include two circle drive systems 140A, 140B, 240A, 240B and may deliver as much or greater torque to circle 48 with each circle drive motors 148A, 148B, 248A, 248B being smaller than the circle drive motor of a motor grader 10 with a single circle drive motor. Additionally or alternatively, each gear box 150A, 150B, 250A, 250B may be smaller or include fewer spur gear assemblies 52, 152A, 152B, 252A, and 252B (with correspondingly fewer parts) and deliver an equal or larger torque on circle 48 than a single circle drive system. In one aspect, each gear box 150A, 150B, 250A, 250B may include a limit on the amount of torque that may be delivered through the gear box and/or the gear reduction of the gear box. In this aspect, including more than one circle drive system 140A, 140B, 240A, 240B, and the corresponding more than one gear box 150A, 150B, 250A, 250B may allow for a greater torque to be delivered and/or a greater gear reduction to take place when controlling the positioning of circle 46 and blade 16. Moreover, the position of the one or more circle drive systems 40, 140A, 140B, 240A, 240B may allow for additional or larger support elements to be coupled to one or more of drawbar 26, circle 46, and blade 16 relative to front frame 12. For example, as shown in FIG. 6, with circle drive system 240A and 240B coupled to a front portion of circle 46, motor grader 10 may include one or more crossbeams 92 connecting drawbar arms 94A and 94B, further strengthening drawbar 26 and supporting the components coupled to drawbar 26.

It will be apparent to those skilled in the art that various modifications and variations can be made to the disclosed machine without departing from the scope of the disclosure. Other embodiments of the machine will be apparent to those skilled in the art from consideration of the specification and practice of the circle drive system for a grading machine disclosed herein. It is intended that the specification and examples be considered as exemplary only, with a true scope of the disclosure being indicated by the following claims and their equivalents.

What is claimed is:

1. A grading machine, comprising:

a machine body;

a circle;

a grading blade supported by the circle;

a drawbar connecting the grading blade and the circle to the machine body; and a circle drive system including a circle drive motor and a gear box, wherein the gear box is configured to engage with and rotate the circle relative to the drawbar around a circle axis, wherein the gear box includes a first gear that rotates about a first fixed axis of rotation that is parallel to the circle axis, and wherein the gear box includes a second tear that rotates about a second fixed axis that is parallel to the circle axis and spaced away from the first fixed axis of rotation, wherein the second gear is engaged with the first gear;

wherein the circle drive motor includes an axis of rotation that is perpendicular to the circle axis, and further including a gear coupling element that couples the circle dive motor to the gear box;

wherein the gear coupling element is a worm gear drive that includes a worm and a worm gear.

2. The grading machine of claim 1, wherein the circle includes a plurality of teeth, wherein the first gear of the gear box is a first spur gear, wherein the second gear of the gear box is a second spur gear, wherein the first spur gear engages with and rotates the second spur gear, wherein the second spur gear is connected to and coaxial with a shaft and a circle engaging gear, and wherein the circle engaging gear engages with one or more teeth to rotate the circle.

3. The grading machine of claim 1, wherein the worm includes an axis of rotation that is parallel to the axis of rotation of the circle drive motor and perpendicular to the circle axis, and wherein the worm gear drives at least one spur gear.

4. The grading machine of claim 1, wherein the circle drive motor is a first circle drive motor and the gear box is a first gear box, wherein the circle drive system further includes a second circle drive motor and a second gear box, wherein the second gear box is configured to engage with and rotate the circle relative to the drawbar around the circle axis, and wherein the second circle drive motor includes an axis of rotation that is perpendicular to the circle axis.

5. The grading machine of claim 1, further including one or more lift cylinders, wherein the lift cylinders couple the drawbar to the machine body.

6. The grading machine of claim 5, wherein the drawbar, the circle, and the blade are adjustable relative to the machine body via movement of the one or more lift cylinders, wherein the one or more lift cylinders include an extended position in which the blade engages with a ground surface, wherein the one or more lift cylinders include a retracted position in which the blade does not engage with the ground surface, and wherein the circle drive system does not contact the machine body when the blade is in the extended or retracted positions.

7. The grading machine of claim 1, wherein the grading blade is movable clockwise and counterclockwise relative to the drawbar via action of the circle drive system on the circle.

8. The grading machine of claim 1, wherein the circle drive motor is a hydraulic motor.

9. A grading machine, comprising:

a circle including a plurality of teeth;

a grading blade supported by the circle;

a drawbar connected to the circle; and at least one circle drive system including a circle drive motor and a gear box, wherein the circle drive motor is coupled to and rotates a worm, wherein the gear box includes a worm gear that engages with and is rotated by the worm, wherein the gear box includes a first gear coupled to a first shaft that is rotated by the worm gear, wherein the first gear and the first shaft rotate around a first gear box axis of rotation, wherein the gear box includes a second gear coupled to a second shaft, wherein the first gear engages with and rotates the second gear, wherein the second gear and the second shaft rotate around a second gear box axis of rotation, wherein the first gear box axis of rotation and the second gear box axis of rotation are parallel and spaced apart, and wherein the second shaft includes a circle engaging gear that engages with the teeth to rotate the circle.

10. The grading machine of claim 9, wherein the grading machine includes a first circle drive system and a second circle drive system coupled to the circle.

11. The grading machine of claim 10, wherein the first circle drive system is coupled to a front portion of the circle, and wherein the second circle drive system is coupled to a rear portion of the circle.

12. The grading machine of claim 10, wherein the first circle drive system and the second circle drive system are coupled to a front portion of the circle at laterally offset positions relative to a centerline of the machine.

13. The grading machine of claim 9, wherein the gear box of each circle drive system includes at least two spur gears, wherein each circle drive system includes a worm gear drive with a worm and a worm gear that couples the circle drive motor to the gear box, and wherein the worm gear drives at least one spur gear.

14. A circle drive system for a grading machine, comprising:

a circle coupled to a grading blade, wherein the circle is rotatable around a circle axis; and a circle drive system, including a circle drive motor with a motor axis, wherein the motor axis is perpendicular to the circle axis;

a gear coupling coupled to the circle drive motor; and a gear box driven by the circle drive motor and the gear coupling, wherein the gear box is configured to engage with and drive a rotation of the circle, wherein the gear box includes at least a first spur gear that rotates about a first axis of rotation and a second spur gear that rotates about a second axis of rotation, wherein the first axis of rotation and the second axis of rotation are parallel to each other and to the circle axis, wherein the first axis of rotation and the second axis of rotation are offset from each other, and wherein the first spur gear is driven by the gear coupling, wherein the first spur gear engages with and drives the second spur gear coupled to a second shaft and a circle engaging gear, wherein the second spur gear, the second shaft, and the circle engaging gear rotate about the second axis of rotation, and wherein the circle engaging gear engages with and rotates the circle.

15. The circle drive system of claim 14, wherein the gear coupling is a worm gear drive that includes a worm and a worm gear, wherein the worm includes a worm axis that is parallel to the motor axis, wherein the gear box includes a first shaft and the first spur gear, wherein the worm gear rotates the first shaft and the first spur gear about the first axis of rotation.

16. The circle drive system of claim 14, further including at least one movable cylinder coupled to a drawbar to adjust a height of the drawbar, the circle, and the blade between at least an extended position in which the blade engages a ground surface and a retracted position in which the blade is elevated from the ground surface.

17. The circle drive system of claim 14, further including a drawbar, wherein the blade is movable clockwise and counterclockwise relative to the drawbar, and wherein the circle drive system further includes at least one position sensor coupled to the circle or to the grading blade to detect a position of the circle or the grading blade.

18. The circle drive system of claim 14, wherein the first axis of rotation and the second axis of rotation are perpendicular to the motor axis.

* * * * *